US011234567B2

(12) United States Patent
Thorne et al.

(10) Patent No.: US 11,234,567 B2
(45) Date of Patent: Feb. 1, 2022

(54) VACUUM CLEANER TOOL HAVING A ROTATABLE DUCT FOR MOVING BETWEEN A USE POSITION AND STORAGE POSITION ON A VACUUM CLEANER

(71) Applicant: SharkNinja Operating, LLC, Needham, MA (US)

(72) Inventors: Jason B. Thorne, Dover, MA (US); Alexander Calvino, Cranston, RI (US); Mingshun Su, Suzhou (CN); Robert Yang, Suzhou (CN); Charlie Cai, Wuhan (CN); Gordon Howes, Suzhou (CN); Brian M. Bond, Woburn, MA (US); Leanna Cornelius, Acton, MA (US)

(73) Assignee: SharkNinja Operating LLC, Needham, MA (US)

( * ) Notice: Subject to any disclaimer, the term of this patent is extended or adjusted under 35 U.S.C. 154(b) by 297 days.

(21) Appl. No.: 16/117,894

(22) Filed: Aug. 30, 2018

(65) Prior Publication Data

US 2019/0069740 A1 Mar. 7, 2019

Related U.S. Application Data

(60) Provisional application No. 62/553,247, filed on Sep. 1, 2017.

(51) Int. Cl.
*A47L 9/00* (2006.01)
*A47L 9/04* (2006.01)
(Continued)

(52) U.S. Cl.
CPC ..... *A47L 9/0027* (2013.01); *A47L 5/30* (2013.01); *A47L 9/0072* (2013.01);
(Continued)

(58) Field of Classification Search
CPC ..... A47L 5/30; A47L 9/0027; A47L 9/0072; A47L 9/0411; A47L 9/0477; A47L 9/246
See application file for complete search history.

(56) References Cited

U.S. PATENT DOCUMENTS 4,776,059 A * 10/1988 Worwag ..... A47L 9/02 15/331
5,046,218 A * 9/1991 Cerri ..... A47L 9/06 15/416

(Continued)

FOREIGN PATENT DOCUMENTS

CN 1212143 A * 3/1999
CN 1212143 A 3/1999
JP S63222721 A 9/1988

OTHER PUBLICATIONS

PCT Search Report and Written Opinion dated Nov. 1, 2018, received in corresponding PCT Application No. PCT/US18/48858, 11 pgs.

(Continued)

*Primary Examiner* — Marc Carlson
(74) *Attorney, Agent, or Firm* — Grossman Tucker Perreault & Pfleger, PLLC

(57) ABSTRACT

A vacuum cleaner tool having a brush head, a rotatable duct, and a hinge. The rotatable duct is configured to receive a hose or wand and rotates about the hinge relative to the brush head, between a use position and storage position. In a storage position, the rotatable duct extends generally parallel, or in-line with the brush head and, in a use position, the rotatable duct extends generally perpendicular to the brush head. The vacuum cleaner tool may removably attach to the vacuum cleaner via a release on one end of the brush head interacting with a fixed catch on the vacuum cleaner.

19 Claims, 14 Drawing Sheets

(51) Int. Cl.
*A47L 9/24* (2006.01)
*A47L 5/30* (2006.01)

(52) U.S. Cl.
CPC ..... *A47L 9/0411* (2013.01); *A47L 9/0477* (2013.01); *A47L 9/246* (2013.01)

(56) References Cited

U.S. PATENT DOCUMENTS

2003/0217431 A1* 11/2003 Uratani ..... A47L 9/066 15/328
2004/0205925 A1* 10/2004 Shanor ..... A47L 9/0018 15/323
2005/0081327 A1* 4/2005 Lim ..... A47L 9/02 15/415.1
2005/0120512 A1* 6/2005 Choi ..... A47L 9/02 15/415.1
2009/0217483 A1* 9/2009 Lee ..... A47L 5/28 15/414
2010/0319158 A1* 12/2010 Ashbee ..... A47L 9/02 15/415.1
2011/0005028 A1* 1/2011 Lee ..... A47L 5/32 15/363
2012/0151713 A1* 6/2012 Krebs ..... A47L 9/02 15/415.1
2012/0216364 A1* 8/2012 Muhlenkamp ..... A47L 9/0054 15/327.1
2016/0157687 A1* 6/2016 Perez ..... A47L 5/28 15/331

OTHER PUBLICATIONS

Chinese Office Action with translation dated Jul. 15, 2020, received in Chinese Patent Application No. 201811013425.0, 13 pgs.
Australian Examination Report dated Jan. 27, 2021, received in Australian Patent Application No. 2018326611, 4 pages.
Chinese Office Action with English translation dated Feb. 19, 2021, received in CN 2018-11013425.0, 6 pgs.
Canadian Office Action dated Apr. 12, 2021, received in Canadian Patent Application No. 3,074,500, 6 pages.
European Search Report dated Apr. 30, 2021, received in European Patent Application No. 18851391.5, 7 pages.

* cited by examiner

VACUUM CLEANER TOOL HAVING A ROTATABLE DUCT FOR MOVING BETWEEN A USE POSITION AND STORAGE POSITION ON A VACUUM CLEANER

CROSS REFERENCE TO RELATED APPLICATIONS

The present application claims the benefit of U.S. Provisional Patent Application Ser. No. 62/553,247 filed Sep. 1, 2017, which is fully incorporated herein by reference.

FIELD OF THE INVENTION

The embodiments of the present invention relate to a powered vacuum cleaner tool mountable, for purposes of storage, to a vacuum cleaner. More particularly, the vacuum cleaner tool includes a rotatable duct movable between a use position and storage position.

BACKGROUND

Vacuum cleaner tools have been staples since the advent of vacuum cleaners. Vacuum cleaner tools were initially unpowered (e.g., wands) and have since been supplemented with powered vacuum tools (e.g., handheld motorized brush heads). In either instance, the vacuum tools removably attach to a vacuum cleaner hose or other vacuum cleaner tool during use. When not in use, vacuum cleaner tools are often stored separate from the vacuum cleaner.

It would be advantageous to develop a powered vacuum cleaner tool configured for easy-to-access storage on the vacuum cleaner.

SUMMARY

The embodiments of the present invention involve a vacuum cleaner tool comprising broadly a brush head and rotatable duct. The brush head comprises a housing containing a rotatable brush device and brush head inlet for sucking in loose debris and debris disrupted by the rotatable brush device. Depending on the embodiment, the rotatable brush device may be driven by a dedicated electromechanical motor or by air suction generated by the vacuum cleaner to which rotatable brush device is attached. The rotatable duct is configured for receiving at one end a hose or wand and rotates about a second end connected to the brush head. The rotatable duct moves between a use position and storage position. In a storage position, the rotatable duct extends generally parallel with, or in-line with, the brush head and, in a use position, the rotatable duct extends generally perpendicular to the brush head.

The vacuum cleaner tool is configured for storage on a subject vacuum cleaner. In one embodiment, the vacuum cleaner tool attaches to the vacuum cleaner via a manually-operated release on one end of the brush head positioned to interact with a fixed catch on the vacuum cleaner. Manually disengaging the release allows the vacuum cleaner tool to be removed from a storage position on the vacuum cleaner.

A seal on the brush head or rotatable duct serves to create a friction-based connection between the brush head and rotatable duct during use. In this manner, the suction at the brush head inlet is not disrupted by any air leaks.

Other variations, embodiments and features of the present invention will become evident from the following detailed description, drawings and claims.

DETAILED DESCRIPTION

Figure 1:
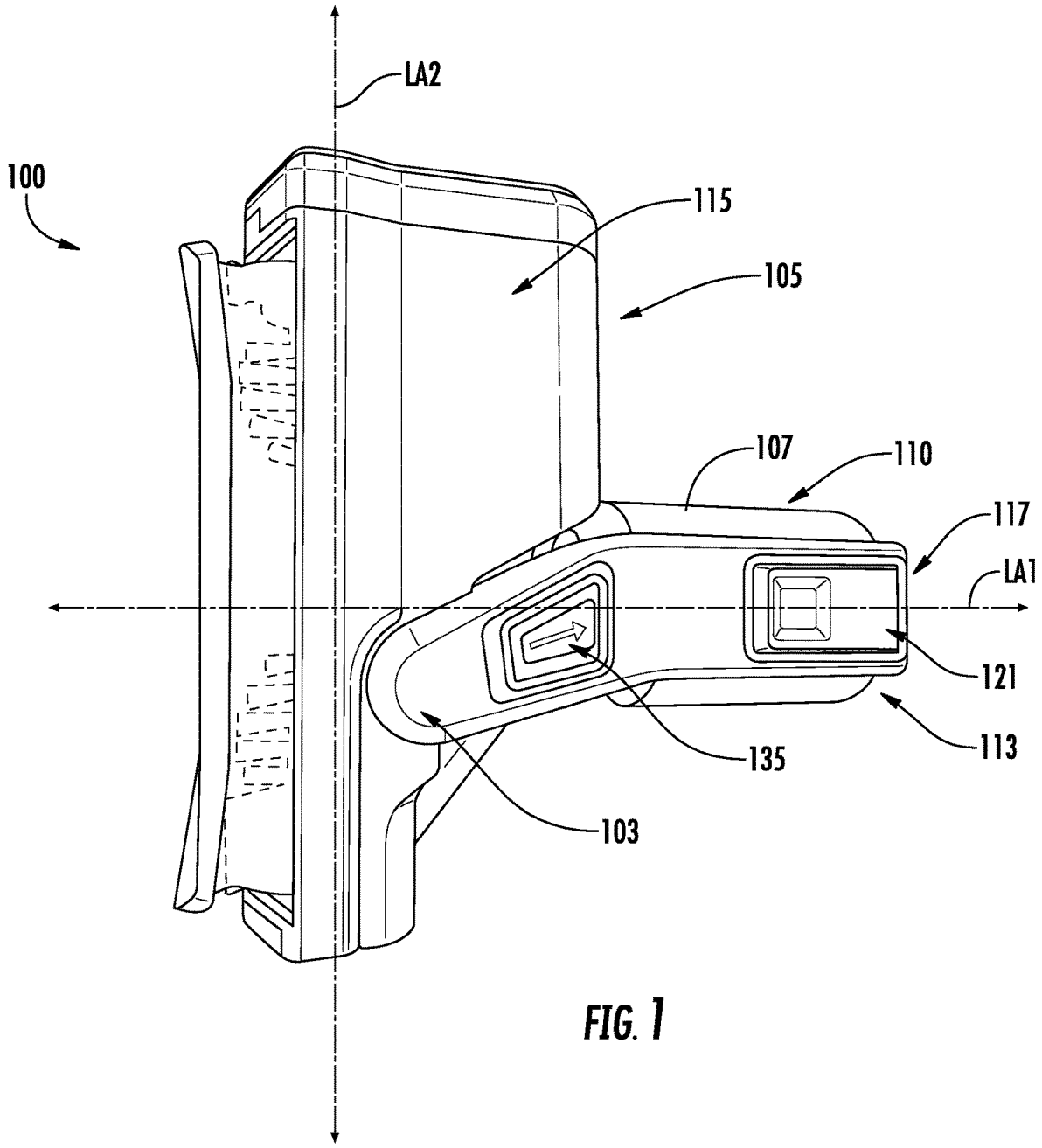
FIG. 1 illustrates a first view of the vacuum cleaner tool in a use position according to the embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the embodiments of the invention disclosed.

Figure 2:
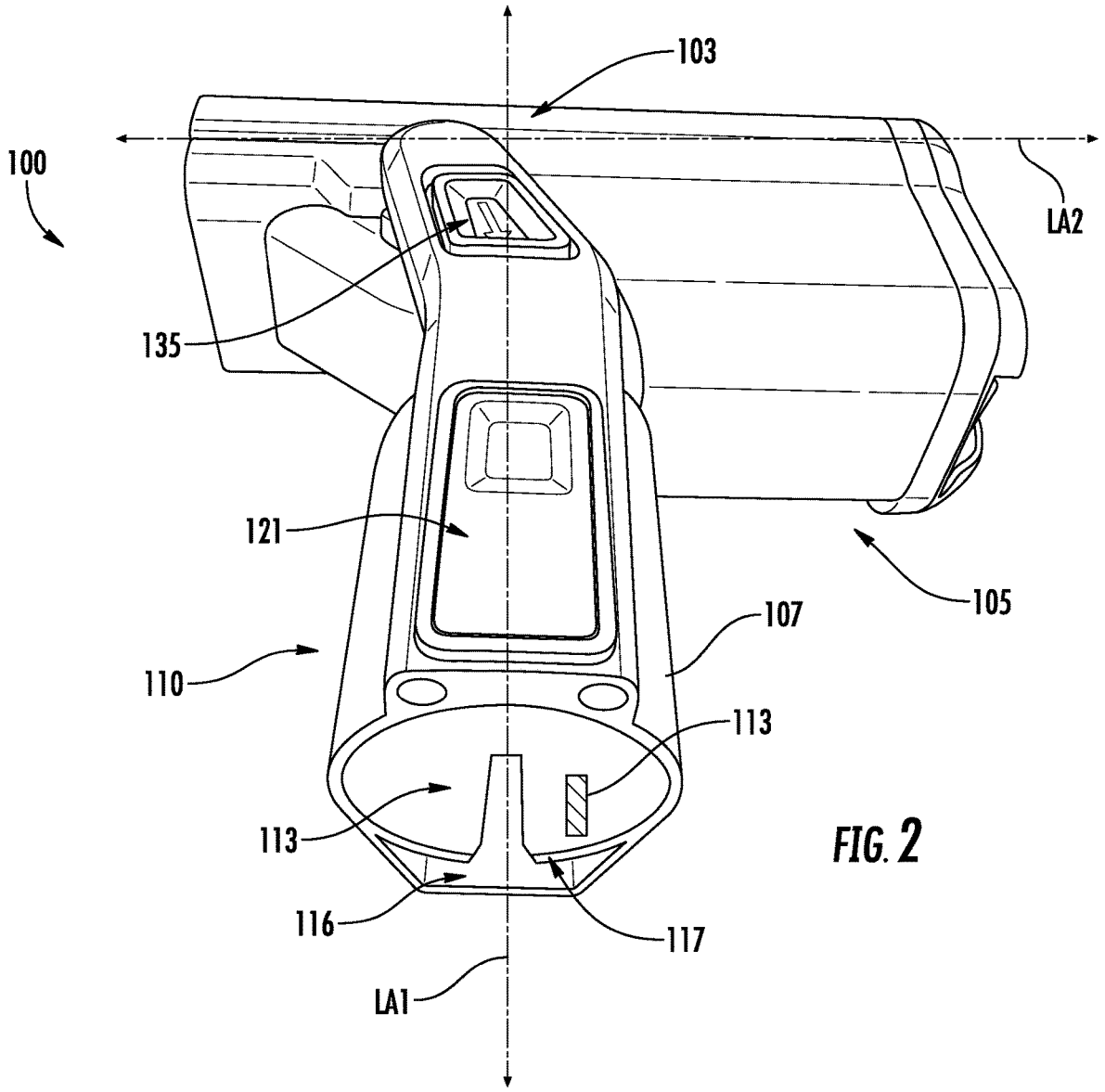
FIG. 2 illustrates a second view of the vacuum cleaner tool in a use position according to the embodiments of the present invention.
Figure 3:
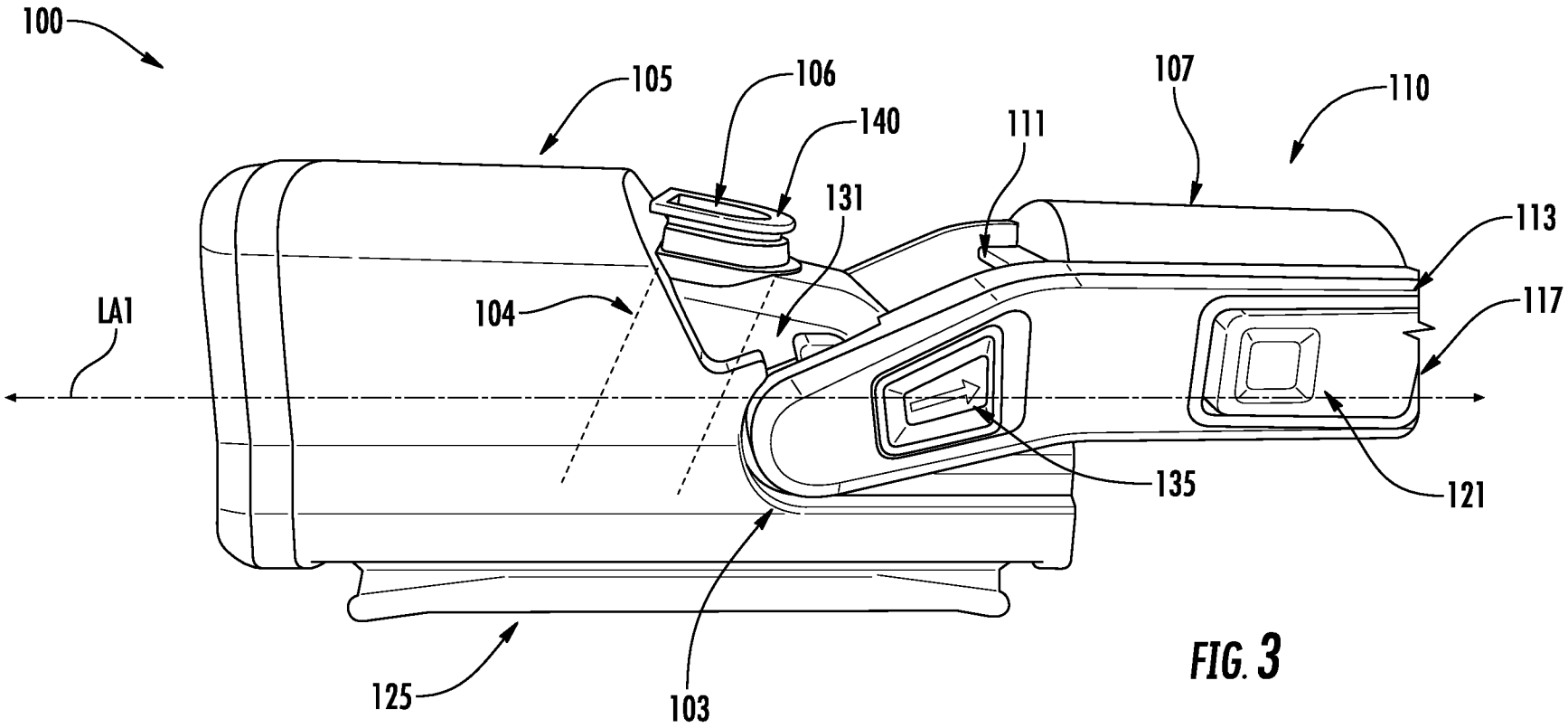
FIG. 3 illustrates a first perspective view of the vacuum cleaner tool in a storage position according to the embodiments of the present invention.
Figure 4:
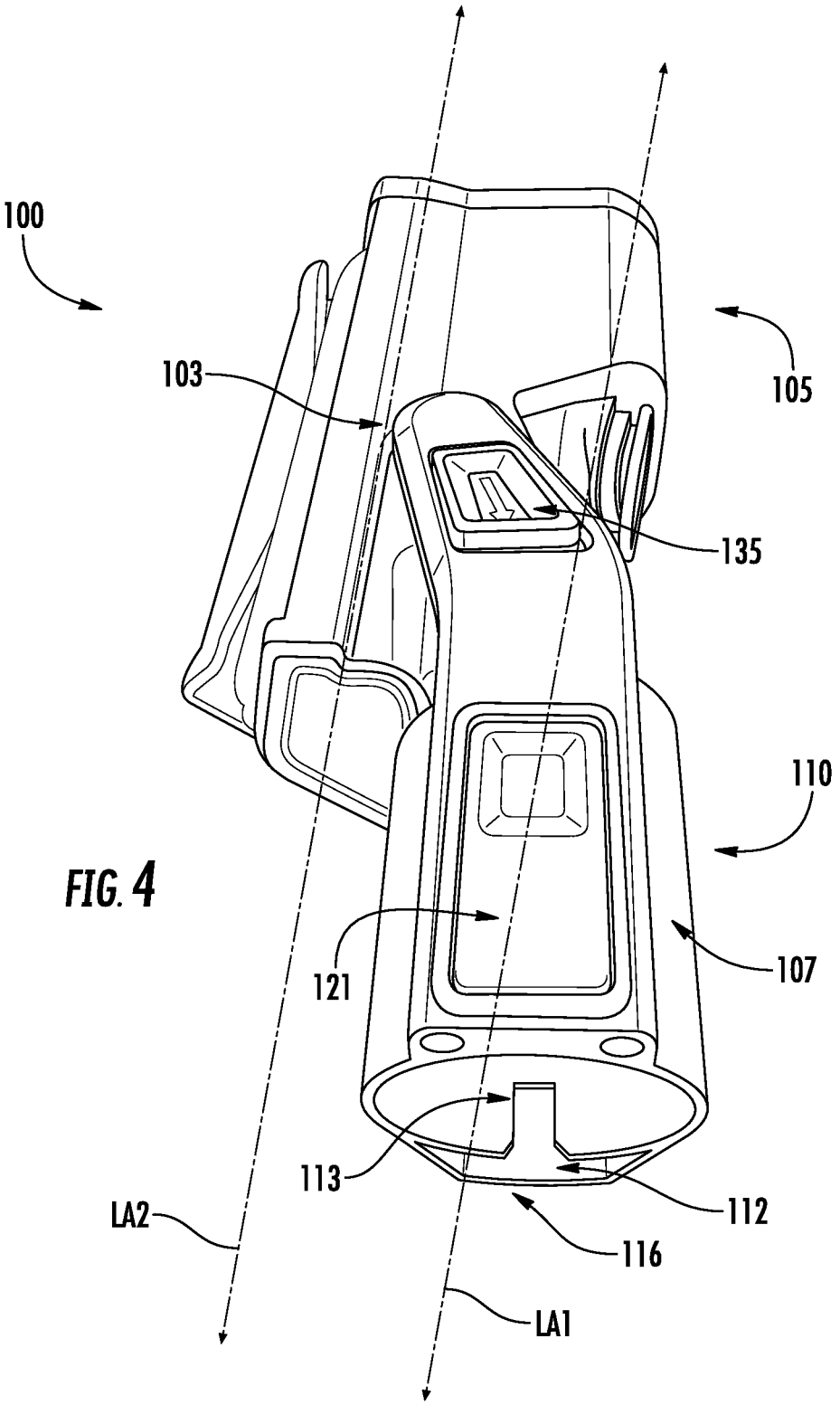
FIG. 4 illustrates a second perspective view of the vacuum cleaner tool in a storage position according to the embodiments of the present invention.

FIGS. 1-5 show a vacuum cleaner tool 100 configured to be fluidly coupled to a vacuum cleaner in accordance with the embodiments of the present invention. The vacuum cleaner tool 100 comprises a brush head 105, a rotatable duct 110, and one or more hinges 103 configured to allow the rotatable duct 110 to move between a use-position (e.g., as generally illustrated in FIGS. 1 and 2) and a storage-position as generally illustrated in FIGS. 3-6. As shown in FIGS. 1 and 4, the rotatable duct 110 may be configured to rotate generally 90° relative to the brush head 105 between the use position and storage position. The angular rotation of the rotatable duct 110 relative to the brush head 105 may be defined by the longitudinal axis LA1 of the rotatable duct 110 and the longitudinal axis LA2 of the brush head 105. Those skilled in the art will recognize that the angular rotation range may be more, or less, than 90°. For example, the rotatable duct 110 may be configured to rotate generally 45° to 135° relative to the brush head 105, e.g., 60° to 110° relative to the brush head 105, e.g., generally 70° to 100° relative to the brush head 105, and/or any range or value therein. In one embodiment, the rotatable duct 110 is configured between a use-position in which the longitudinal axis LA1 of the rotatable duct 110 is generally perpendicular to the longitudinal axis LA2 of the brush head 105, and a storage position in which the longitudinal axis LA1 of the rotatable duct 110 is generally parallel to the longitudinal axis LA2 of the brush head 105. It should be appreciated that the longitudinal axis LA1 of the rotatable duct 110 does not have to be perpendicular to the longitudinal axis LA2 of the brush head 105 when in the use-position, but rather may be at an angle of 45° to 135° relative to the longitudinal axis LA2 of the brush head 105 when in the use-position. Similarly, it should be appreciated that the longitudinal axis LA1 of the rotatable duct 110 does not have to be parallel to the longitudinal axis LA2 of the brush head 105 when in the storage position, but rather may be at an angle of +/−45° relative to the longitudinal axis LA2 of the brush head 105 when in the storage position.

Figure 6:
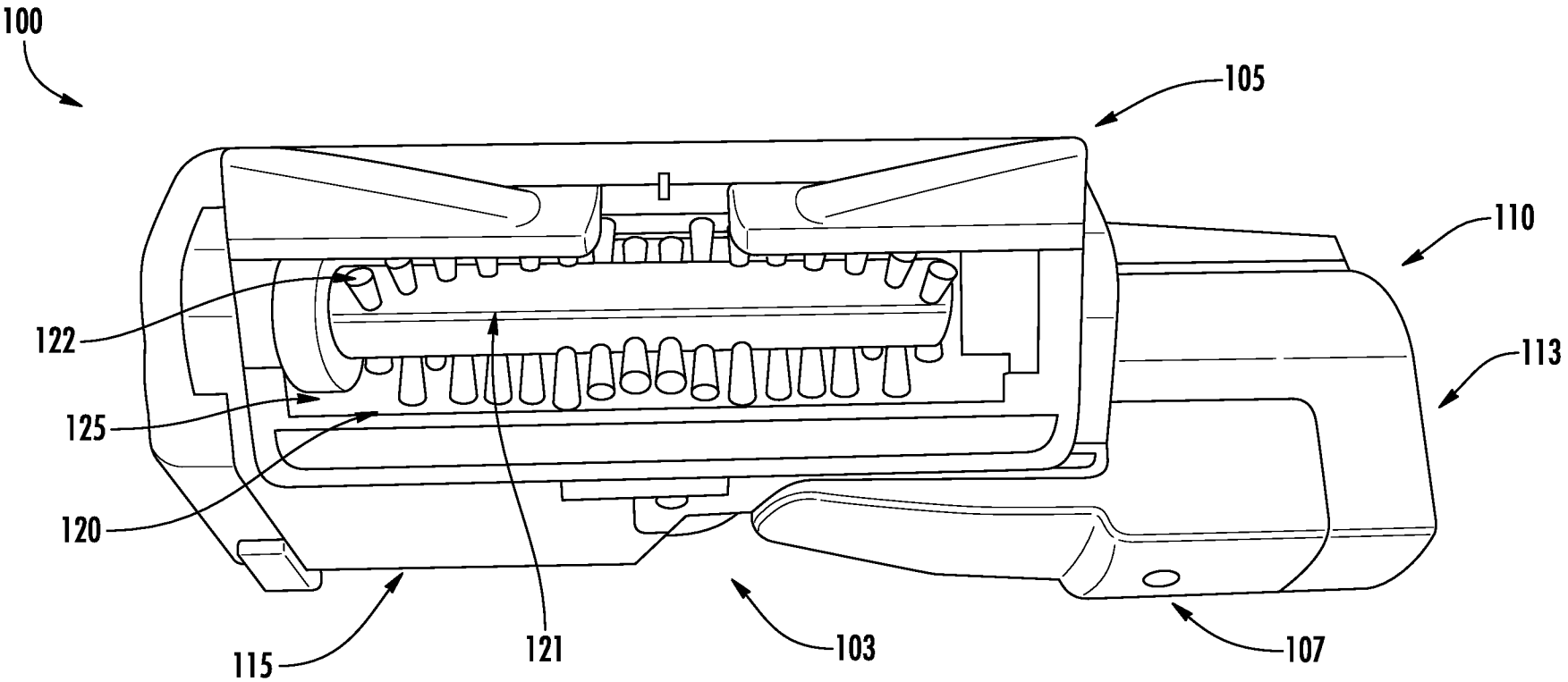
FIG. 6 illustrates the brush head inlet according to the embodiments of the present invention.

With reference to FIG. 3, the brush head 105 comprises a housing 115 containing brush head inlet 125. The head inlet 125 may be fluidly coupled and proximate to a first end of one or more ducts 104 (FIG. 3) defined, at least in part, by the brush head 105. The second, generally opposite end of the duct 104 may define a vacuum opening 106 configured to be fluidly coupled to the rotatable duct 110 as described herein. As best seen in FIG. 6, the brush head 105 optionally includes a rotatable brush device 120 at least partially rotatably disposed in the brush head inlet 125. Brush head device 120 may include a rod 121 supporting bristles and/or flexible strips 122 extending therefrom. An electromechanical or air driven motor (not shown) may be configured to drive the rod 121 spinning the bristles and/or flexible strips 122 to disrupt debris (e.g., pet hair or fur) for ingestion through the brush head inlet 125 and eventually into the vacuum cleaner.

Figure 5:
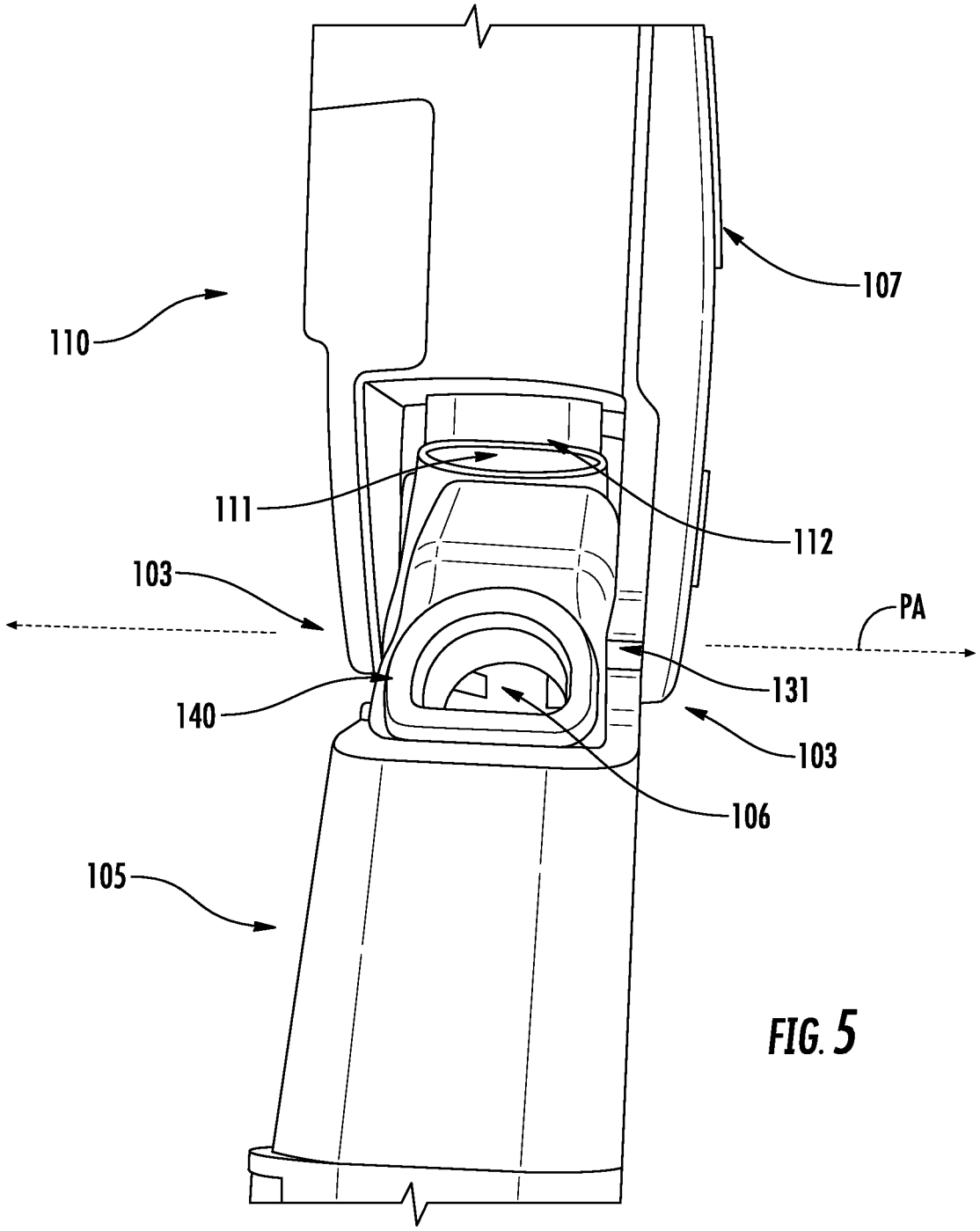
FIG. 5 illustrates a view of the seal associated with the engagement of the vacuum duct and brush head during use according to the embodiments of the present invention.

The rotatable duct 110 includes a body 107 defining a passageway or duct 117 (FIGS. 1-4) having a first or receiving end 113 and a second, generally opposite end 111 (e.g., a vacuum opening or end 111 as generally illustrated in FIGS. 3 and 5). The first or receiving end 113 (FIGS. 1-4) is configured to be fluidly coupled to a wand or hose of the vacuum cleaner with which it to be used. The first or receiving end 113 of the rotatable duct 110 may be connected to the wand or hose via any connection known to those skilled in the art including, but not limited to, a frictional (such as a Morse taper or the like) or mechanical connection (such as a positive mechanical interference or lock or connection). Optionally, the rotatable duct 110 and/or the wand or hose may include a wand release button 121 to disengage/disconnect the rotatable duct 110 from the wand or hose. For example, activation of the wand release button 121 may cause an engagement member on the rotatable duct 110 to engage and/or disengage with a corresponding locking feature on the wand or hose of the vacuum cleaner to releasably secure the rotatable duct 110 to the wand or hose of the vacuum cleaner. Of course, the arrangement of the engagement member and the corresponding locking feature on the rotatable duct 110 and the wand or hose may be reversed.

The second or vacuum end 111 of the rotatable duct 110 may be configured to be selectively fluidly coupled to the vacuum opening 106 of the brush head 105. In particular, the vacuum end 111 of the rotatable duct 110 may be fluidly coupled to the vacuum opening 106 of the brush head 105 when the rotatable duct 110 is pivoted about the hinge 103 to the in-use position as generally illustrated in FIGS. 1-2, and may be fluidly disconnected from vacuum opening 106 of the brush head 105 when the rotatable duct 110 is pivoted about the hinge 103 to the storage position as generally illustrated in FIGS. 3-6. As may be appreciated, the wand or hose directs the suction of the vacuum cleaner through the rotatable duct 110 to the brush head 105, and more particularly the brush head inlet 125, when the vacuum cleaner tool 100 is in the use-position. Now referring to FIG. 5, seal 140 may be provided to maintain the effectiveness of the suction at the brush head inlet 125 by creating a frictional, secure joint between vacuum opening 111 of the rotatable duct 110 and vacuum opening 106 of brush head 105. In one embodiment, the seal 140 is pliable and resilient such that in the use-position, circumferential edge 112 defining the vacuum opening 111 of the rotatable duct 110 presses into seal 140 preventing any meaningful loss of air and thus suction strength. While the seal 140 is shown on the vacuum opening 106 of the brush head 105, it is also conceivable that a seal may instead or additionally be placed on the vacuum opening 111 of the rotatable duct 110.

As noted herein, the rotatable duct 110 is coupled to and rotates relative to the brush head 105 using one or more hinges 103. The hinges 103 defines a pivot axis PA (FIG. 5) and may include any hinge known to those skilled in the art. In the illustrated embodiment, the vacuum cleaner tool 100 includes two hinges 103 disposed on opposite sides of the body 107 of the rotatable duct 110 (e.g., on opposite sides of the duct 104). The use of two hinges 103 allows for the duct 104 to be unobstructed (e.g., compared to having a single hinge with a pivot pin extending through the duct 104 or having to bend the duct 104 around the pivot pin). It should be appreciated, however, that the vacuum cleaner tool 100 may include only one hinge 103 or more than two hinges 103.

The rotatable duct 110 and/or the brush head 105 may include a hinge locks (e.g., but not limited to, a pin and locking groove arrangement or similar mechanical arrangement) to lock the rotatable duct 110 into a use or storage position relative to the brush head 105. In one embodiment, the rotatable duct 110 is manually rotated between the use and storage positions by activating (e.g., sliding) a release member 135 (FIGS. 1-4) and rotating the duct 110 relative to the housing 115 (e.g., from the storage position to the use position and/or from the storage position to the use position). Activation (e.g., sliding) of the release member 135 disengages an engagement member (e.g., tab, hook, pin, or the like which may be coupled to the rotatable duct 110, not shown) from one or more corresponding locking features 131, FIG. 3, (e.g., one or more locking grooves 131 which may be formed in the housing 115). By way of a non-limiting example, the engagement member may include a moveable pin and the corresponding locking features 131 may include at least a first and a second locking groove 131 formed in the housing 115 (only one visible), wherein the first locking groove (i.e., the visible locking in FIG. 3)

corresponds to the use position and the second locking groove corresponds to the storage position. It should be appreciated that release member 135 may be on the brush head 105 and/or the engagement member and the corresponding locking features 131 relative to the brush head 105 and the rotatable duct 110 may be reversed.

In one embodiment, the rotatable duct 110 may include electrical contacts 113, FIG. 2, positioned to mate or otherwise touch corresponding electrical contacts in the wand or hose. For example, electrical contacts 113 may be positioned within a compartment 116 defined by the rotatable duct 110. In such an embodiment, mating of the electrical contacts provides electrical power to drive a motor (not shown) configured to drive the brush head device 120 and/or provide electrical power to one or more lights or the like. Alternatively, the suction created by the vacuum cleaner causes rotation of the brush head device 120.

Figure 7:
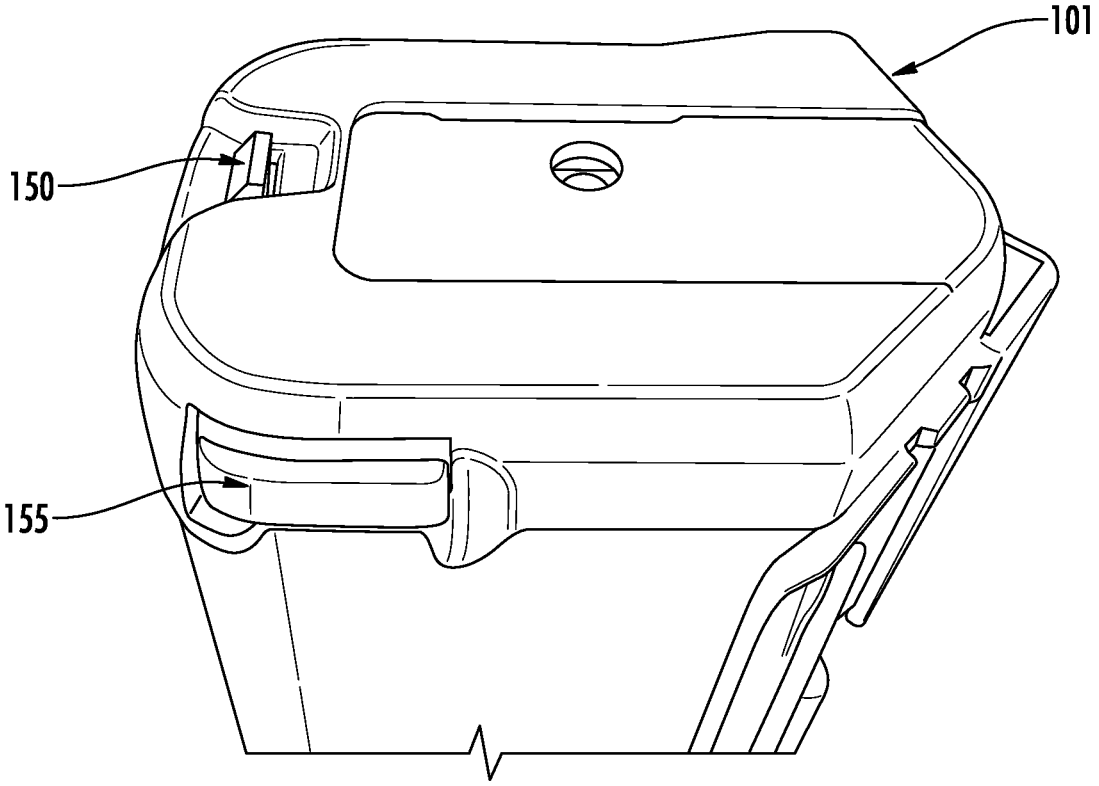
FIG. 7 illustrates the release at one end of the brush head according to the embodiments of the present invention.
Figure 8:
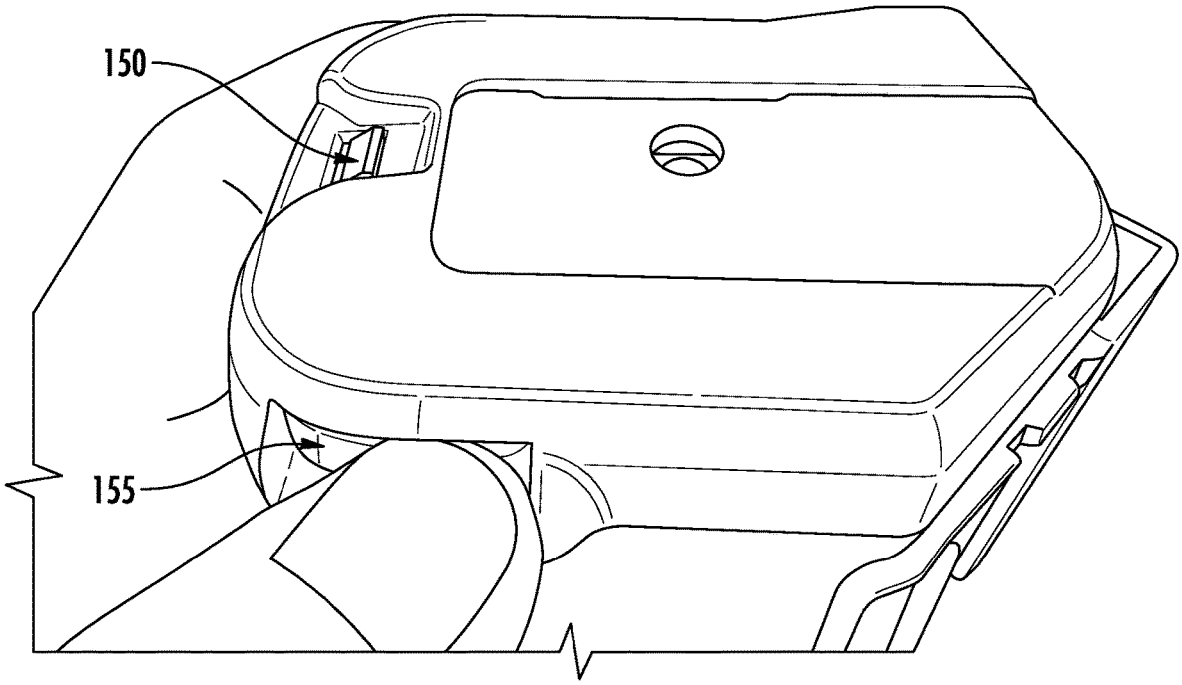
FIG. 8 illustrates operation of the release according to the embodiments of the present invention.

FIGS. 7 and 8 show a storage lock or release 150 associated with the vacuum cleaner tool 100. The storage lock 150 serves to removably secure the vacuum cleaner tool 100 to the vacuum cleaner 200 (shown in FIGS. 9-14), for example, to a base, body, handle, or the like 201. As best seen in FIG. 8, the storage lock 150 is manually operated using button 155. Depressing button 155 causes the storage lock 150 to mechanically depress for purposes detailed below.

Figure 11:
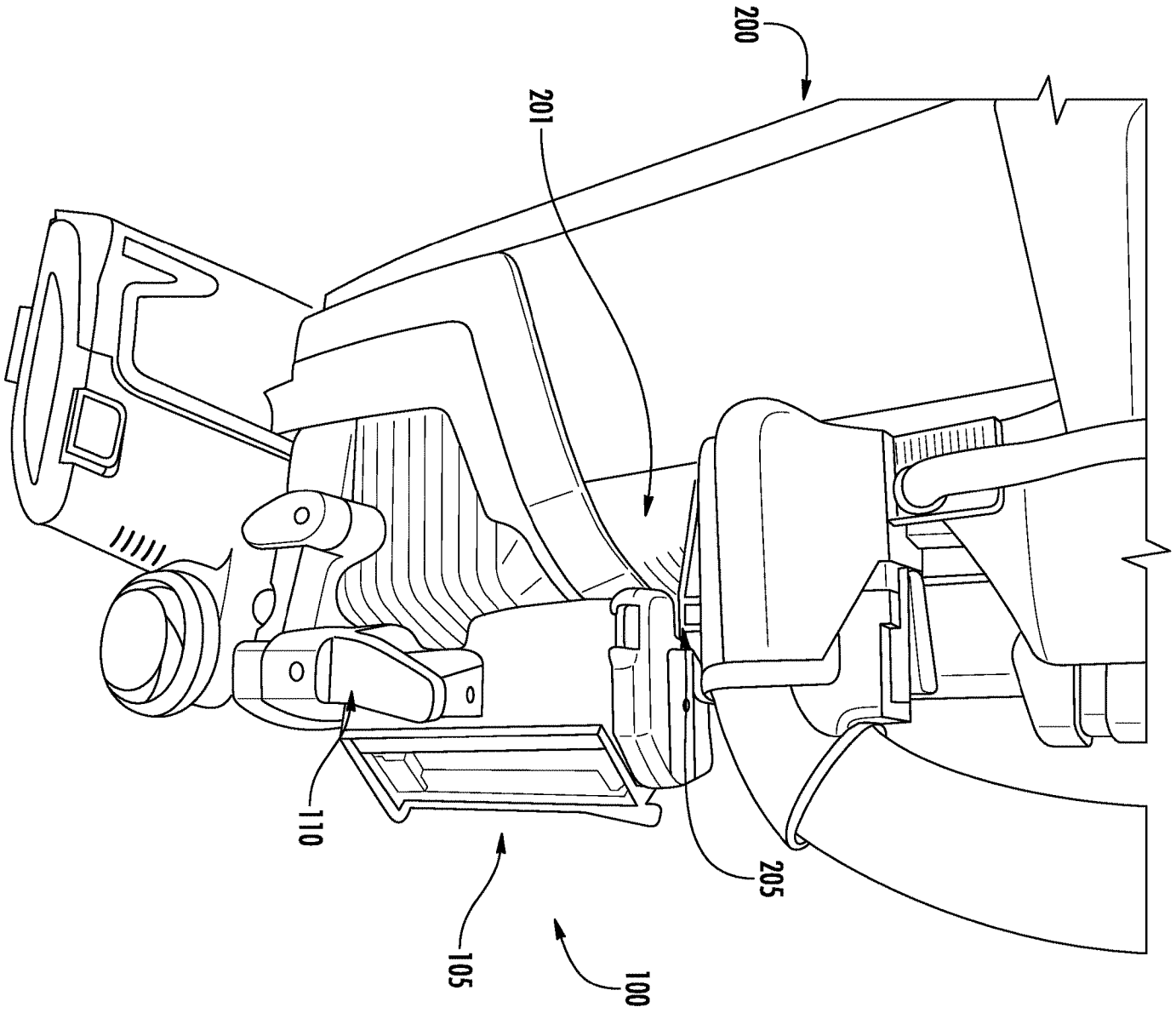
FIG. 11 illustrates a side view of the vacuum cleaner with the vacuum cleaner tool in a stored position according to the embodiments of the present invention.
Figure 12:
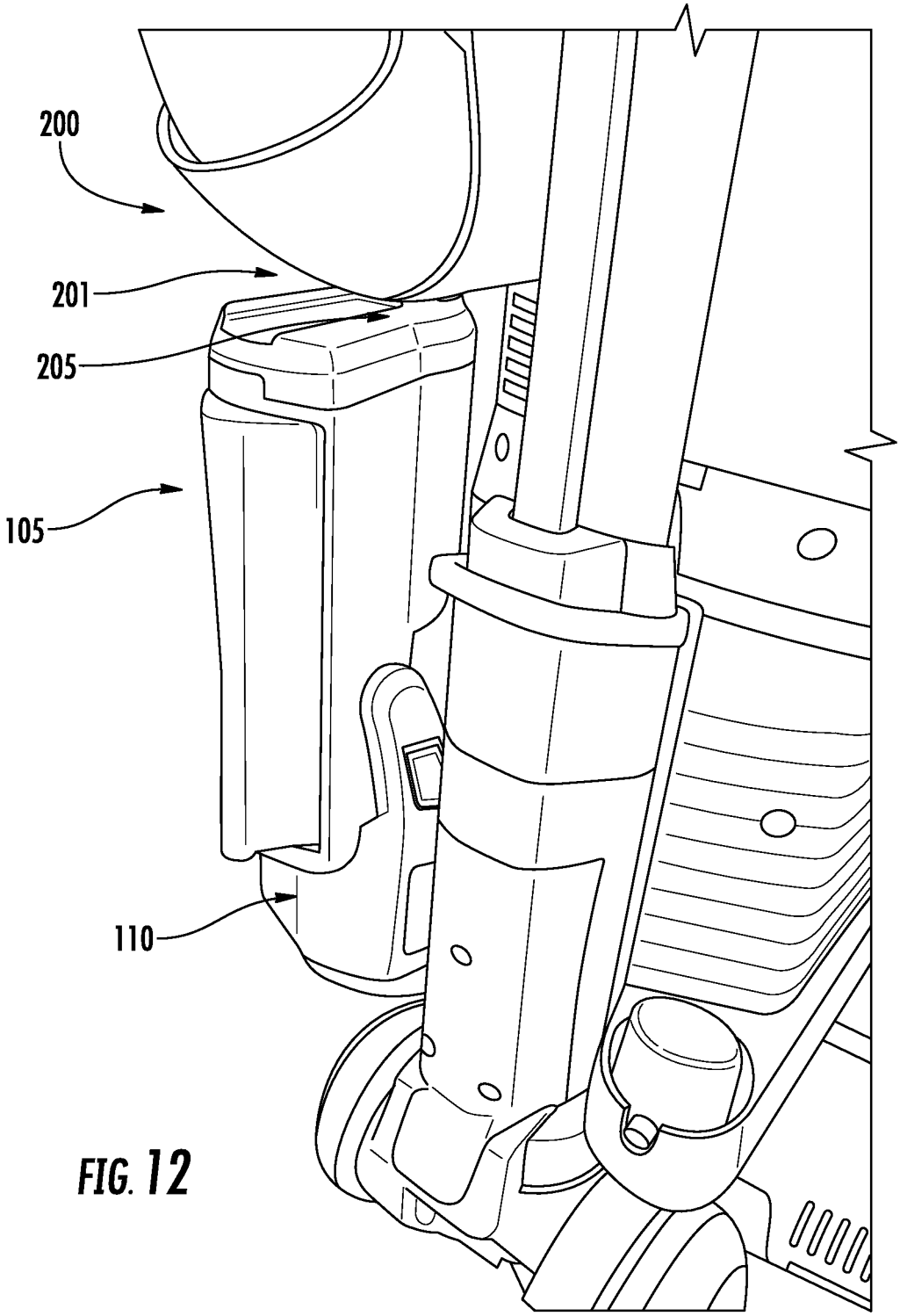
FIG. 12 illustrates a rear view of the vacuum cleaner with the vacuum cleaner tool in a stored position according to the embodiments of the present invention.
Figure 13:
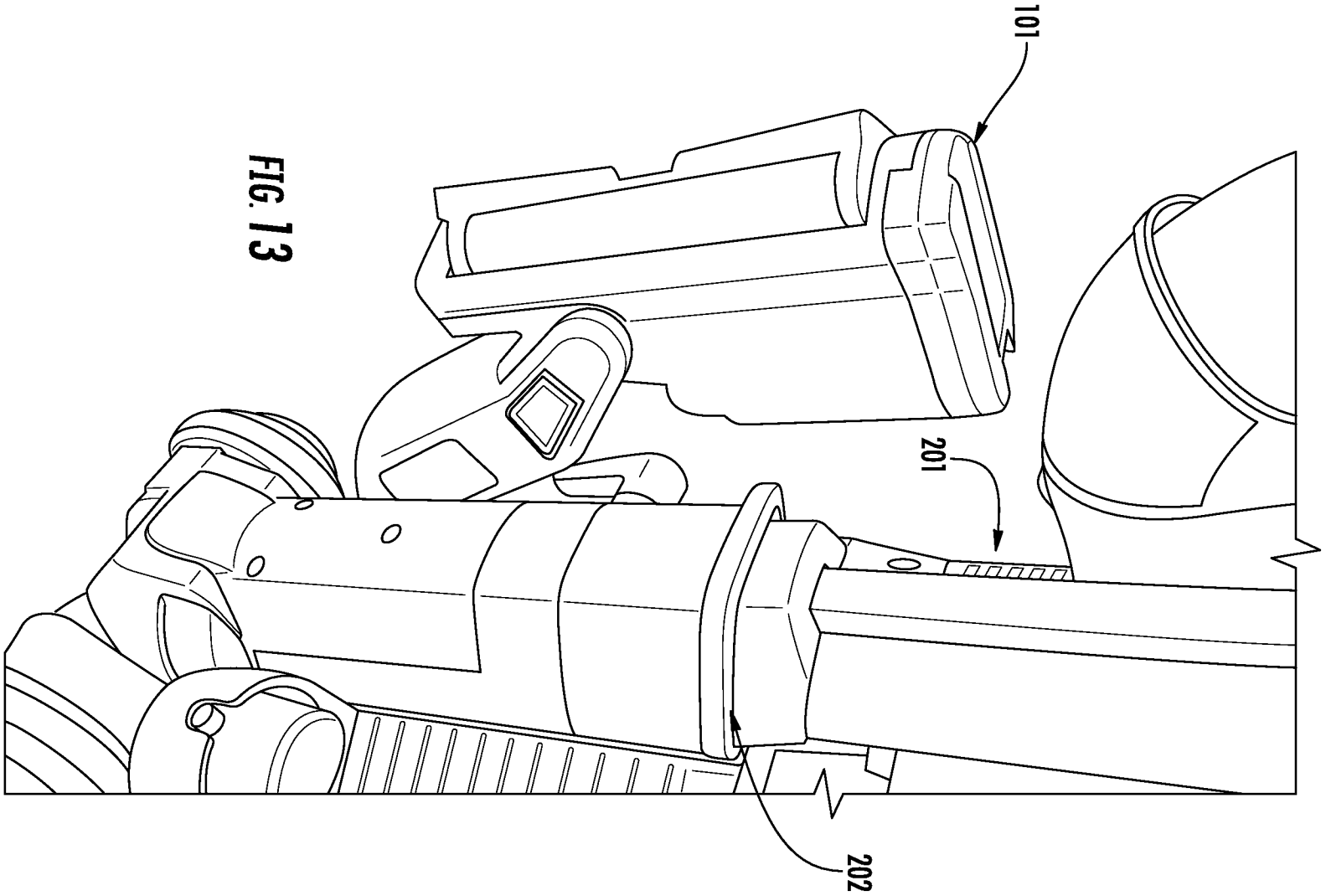
FIG. 13 illustrate a rear view of the vacuum cleaner with the release of the vacuum tool disengaged from the fixed catch of the vacuum cleaner according to the embodiments of the present invention.
Figure 14:
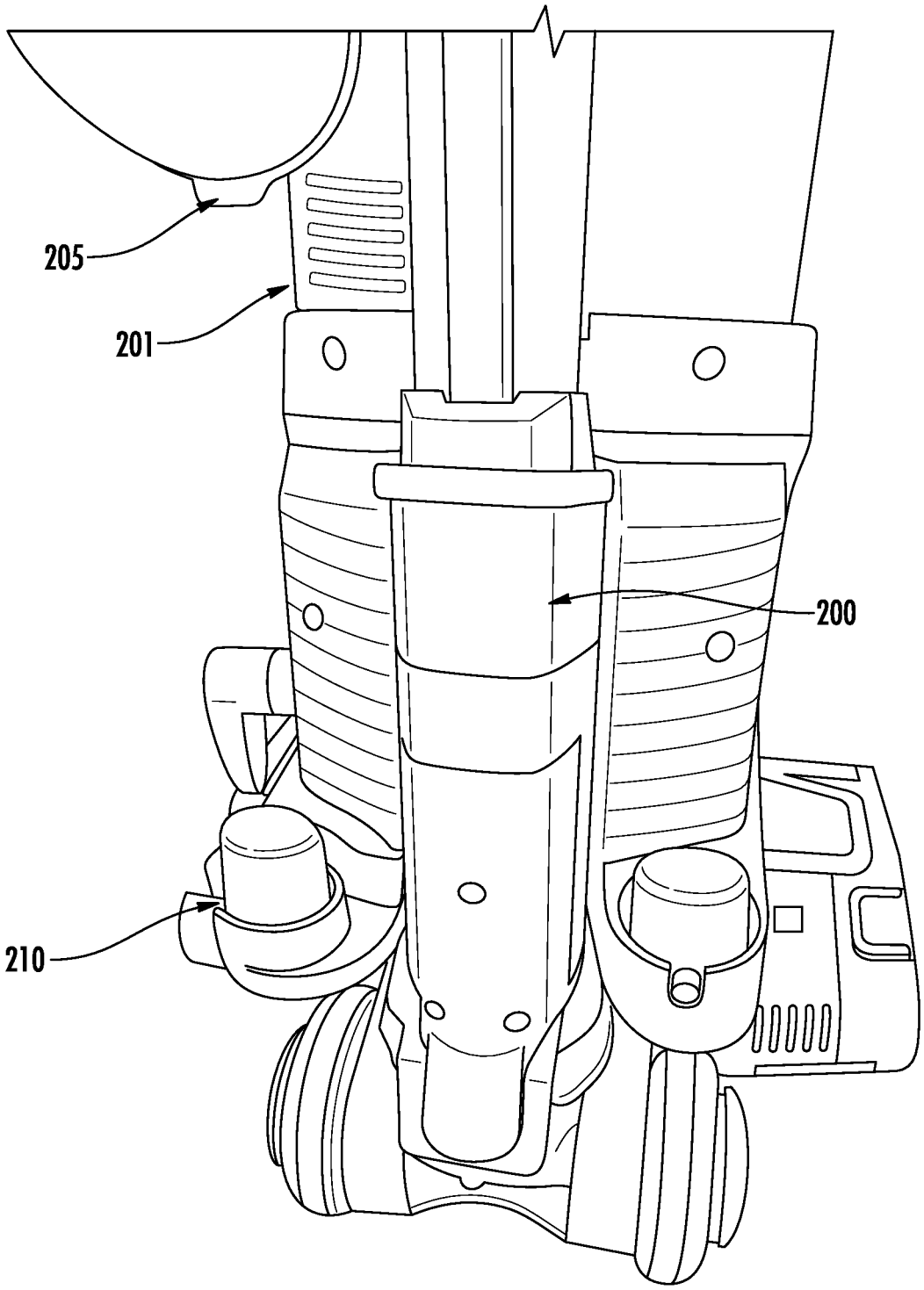
FIG. 14 illustrates the vacuum cleaner with the vacuum cleaner tool removed according to the embodiments of the present invention.

Storage lock 150 provides an effective solution for attaching the vacuum cleaner tool 100 to the vacuum cleaner 200 when in the storage position as best seen in FIGS. 11 and 12. In one embodiment, the vacuum cleaner tool 100 is attached to a lower portion of the vacuum cleaner 200. In other embodiments, the vacuum cleaner tool 100 may attach to the vacuum cleaner 200 at other positions thereon. As mentioned above, and shown in FIGS. 3 and 4, the rotatable duct 110 extends generally parallel to, or in-line with, the brush head 105 when stored creating a slim, elongated profile.

Figure 9:
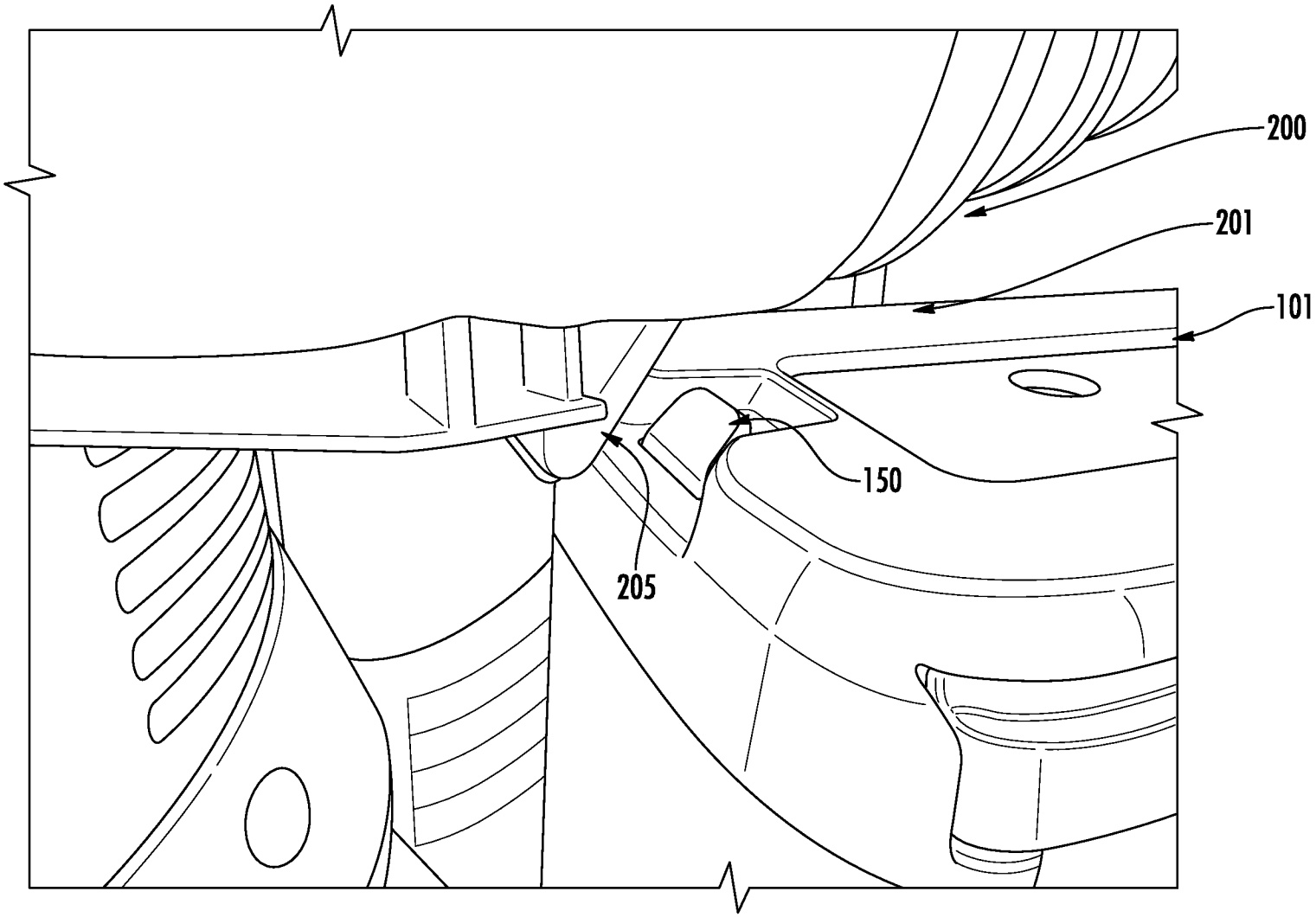
FIG. 9 illustrates the positional relationship between the release of the vacuum cleaner tool and the fixed catch of the vacuum cleaner according to the embodiments of the present invention.
Figure 10:
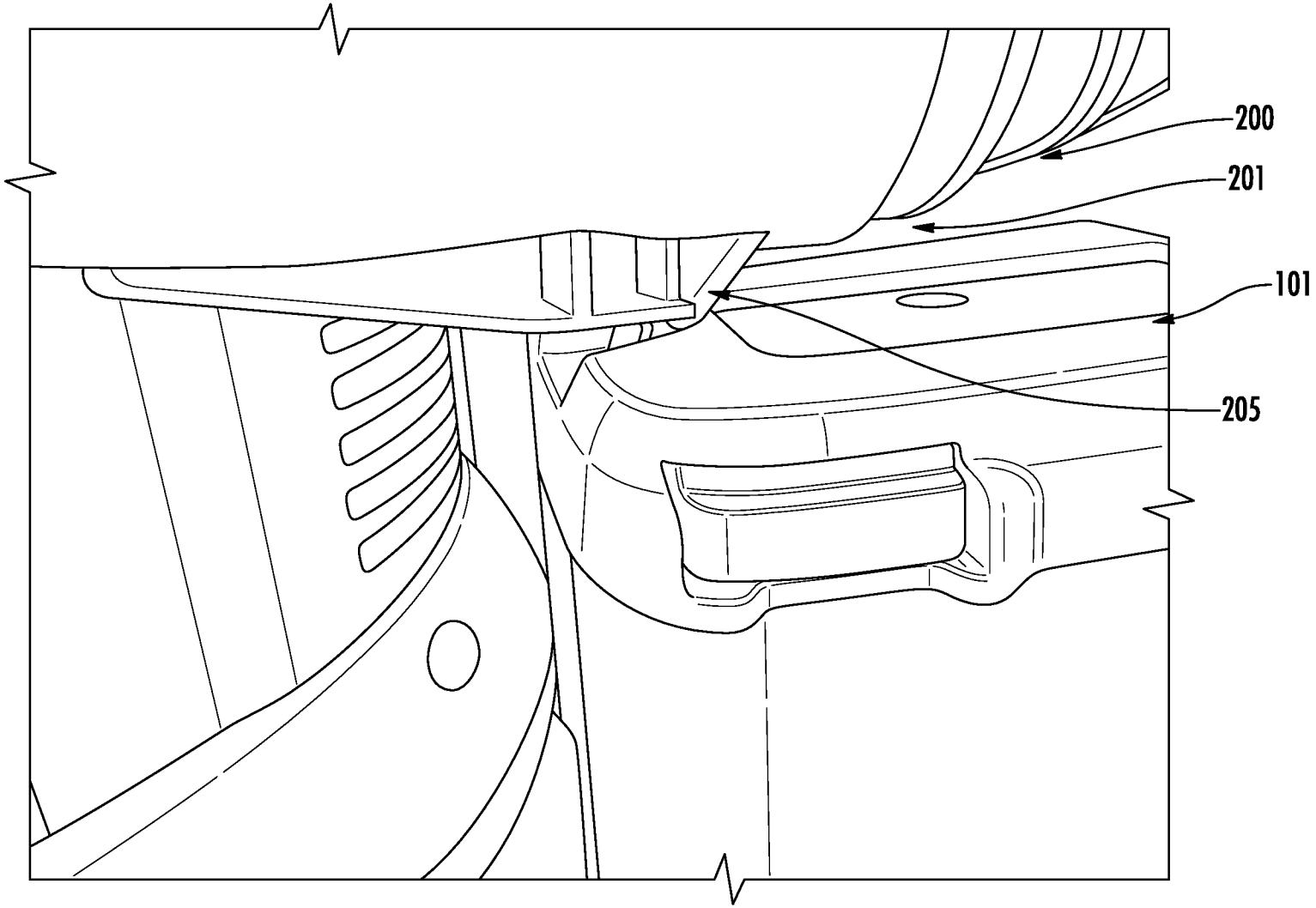
FIG. 10 illustrates the interaction between the release of the vacuum cleaner tool and the fixed catch of the vacuum cleaner according to the embodiments of the present invention.

FIGS. 9 and 10 show the position and operation of the storage lock 150. FIG. 9 shows the storage lock 150 positioned for attachment to the vacuum cleaner 200. The storage lock 150 is positioned to engage a fixed catch 205 integral with the vacuum cleaner 200. When engaged, as shown in FIG. 10, the storage lock 150 secures one end 101 (e.g., a first lateral end) of the vacuum cleaner tool 100 (e.g., the end 101 of the brush head 105) to the vacuum cleaner 200 (e.g., the storage lock 150 secures the end 101 of the brush head 105 to the fixed catch 205 which is part of the vacuum cleaner 200). The other end of the vacuum cleaner tool 100 (e.g., the receiving end 113 of the rotatable duct 110), may be configured to slide over a vertical stay 210 (best seen in FIG. 14) of the vacuum cleaner 200. As shown, the vacuum cleaner tool 100 is stored in a generally vertical orientation. In practice, to attach the vacuum cleaner tool 100 to the vacuum cleaner 200, the receiving end 113 is first positioned over stay 210 after which the storage lock 150 is moved into engagement with catch 205. To remove the vacuum cleaner tool 100, the storage lock 150 is manually disengaged from the catch 205 (see FIG. 13) and the receiving end 113 of the vacuum cleaner tool 100 is lifted off the stay 210. In both instances, the rotatable duct 110 permits the released brush head 105 to be moved away from interference with the vacuum cleaner 200 so that the vacuum cleaner tool 100 is free to be lifted off the stay 210.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. It will be appreciated by a person skilled in the art that a surface cleaning apparatus and/or agitator may embody any one or more of the features contained herein and that the features may be used in any particular combination or sub-combination. Modifications and substitutions by one of ordinary skill in the art are considered to be within the scope of the present invention, which is not to be limited except by the following claims.

What is claimed is:

1. A vacuum cleaner tool comprising:

a brush head comprising a housing including a brush head inlet and a duct, said duct comprising a first end fluidly coupled to said brush head inlet and a second, generally opposite end;

a rotatable duct comprising a body defining a passageway having a first end configured to be fluidly coupled to a wand or a hose of a vacuum cleaner, and a second, generally opposite end configured to be selectively fluidly coupled to said second end of said duct of said brush head;

a hinge pivotally coupling said rotatable duct to said brush head and configured to allow said rotatable duct to pivot between a use-position in which said second end of said rotatable duct is fluidly coupled to said second end of said brush head, and a storage position in which said second end of said rotatable duct pivots about said hinge to separate from rotatable duct such that said rotatable duct is out of fluid engagement with said second end of said brush head while remaining pivotally coupled to said brush head.

2. The vacuum cleaner tool of claim 1, wherein said rotatable duct is configured to rotate 45° to 135° relative to said brush head.

3. The vacuum cleaner tool of claim 2, wherein said rotatable duct is configured to rotate approximately 90° relative to said brush head.

4. The vacuum cleaner tool of claim 1, wherein a longitudinal axis of said rotatable duct is configured to be generally perpendicular to a longitudinal axis of said brush head when in said use-position.

5. The vacuum cleaner tool of claim 1, wherein a longitudinal axis of said rotatable duct is configured to be generally parallel to a longitudinal axis of said brush head when in said storage position.

6. The vacuum cleaner tool of claim 1, wherein a longitudinal axis of said rotatable duct is configured to be generally perpendicular to a longitudinal axis of said brush head when in said use-position and wherein said longitudinal axis of said rotatable duct is configured to be generally parallel to said longitudinal axis of said brush head when in said storage position.

7. The vacuum cleaner tool of claim 1, wherein said brush head further includes an agitator at least partially rotatably disposed in said brush head inlet.

8. The vacuum cleaner tool of claim 7, wherein said first end of said rotatable duct further includes at least one electrical connection configured to supply electrical power to a motor disposed in said brush head to rotate said agitator.

9. The vacuum cleaner tool of claim 1, further comprising a hinge lock to secure said rotatable duct in said in-use position.

10. The vacuum cleaner tool of claim 1, further comprising a hinge lock to secure said rotatable duct in said storage position.

11. The vacuum cleaner tool of claim 10, further comprising a storage lock to secure said vacuum cleaner tool to a base of said vacuum cleaner in said storage position.

12. The vacuum cleaner tool of claim 11, wherein said first end of said rotatable duct is further configured to receive a vertical stay of said base to secure said first end of said rotatable duct to said base when in said storage position.

13. The vacuum cleaner tool of claim 12, wherein said storage lock is disposed on said brush head.

14. The vacuum cleaner tool of claim 12, wherein said storage lock is configured to secure a lateral end of said brush head to said base.

15. The vacuum cleaner tool of claim 1, further comprising a seal about at least one said second end of said rotatable duct or said second end of said brush head, said seal preventing air from escaping when second ends of said rotatable duct and said brush head are aligned.

16. The vacuum cleaner tool of claim 1, further comprising a seal about at least one said second end of said rotatable duct or said second end of said brush head, said seal configured to prevent air from escaping only when said vacuum cleaner tool is arranged in said in-use position and second ends of said rotatable duct and said brush head are aligned.

17. A vacuum cleaner system comprising:

a vacuum cleaner comprising a flexible vacuum hose, a cleaning head, and a base pivotally coupled to said cleaning head, said base further comprising a vertical stay; and a vacuum cleaner tool comprising:

a brush head comprising a housing including a brush head inlet and a duct, said duct comprising a first end fluidly coupled to said brush head inlet and a second, generally opposite end;

a rotatable duct comprising a body defining a passageway having a first end configured to be fluidly coupled to said vacuum hose of said vacuum cleaner, and a second, generally opposite end configured to be selectively fluidly coupled to said second end of said duct of said brush head; and a hinge pivotally coupling said rotatable duct to said brush head and configured to allow said rotatable duct to move between a use-position in which said second end of said rotatable duct is fluidly coupled to said second end of said brush head, and a storage position in which said second end of said rotatable duct is disconnected from said second end of said brush head and is further configured to receive at least a portion of said vertical stay; and a storage lock to secure said vacuum cleaner tool to said base of said vacuum cleaner in said storage position;

wherein a longitudinal axis of said rotatable duct is configured to be generally perpendicular to a longitudinal axis of said brush head when in said use-position; wherein said longitudinal axis of said rotatable duct is configured to be generally parallel to said longitudinal axis of said brush head when in said storage position; and wherein said hinge is located at a position that is offset from said longitudinal axis of said rotatable duct and said longitudinal axis of said brush head.

18. The vacuum cleaner system of claim 17, wherein said vacuum cleaner tool further comprises a hinge lock to secure said rotatable duct in said in-use position and to secure said rotatable duct in said storage position.

19. The vacuum cleaner system of claim 17, wherein said brush head further includes an agitator at least partially rotatably disposed in said brush head inlet.

* * * * *